US005703565A

United States Patent [19]

Herring

[11] Patent Number: 5,703,565

[45] Date of Patent: Dec. 30, 1997

[54] TRANSFORMER COUPLED SWITCHING TRANSMITTER FOR ELECTRONIC ARTICLE SURVEILLANCE SYSTEM

[75] Inventor: Richard L. Herring, Coconut Creek, Fla.

[73] Assignee: Sensormatic Electronics Corporation, Boca Raton, Fla.

[21] Appl. No.: 605,980

[22] Filed: Feb. 23, 1996

[51] Int. Cl.[6] ..... G08B 13/14

[52] U.S. Cl. ..... 340/572; 323/355

[58] Field of Search ..... 340/572, 693; 323/355

[56] References Cited

U.S. PATENT DOCUMENTS

| | | | |
|---|---|---|---|
| H1571 | 8/1996 | Hansen et al. | 343/728 |
| 3,078,348 | 2/1963 | McIntosh | 455/49.1 |
| 3,934,202 | 1/1976 | Missale | 455/50.1 |
| 4,384,281 | 5/1983 | Cooper | 340/572 |
| 4,519,066 | 5/1985 | Barrett, Jr. et al. | 340/572 X |
| 4,573,042 | 2/1986 | Boyd et al. | 340/572 X |
| 4,975,681 | 12/1990 | Watkins et al. | 340/572 |
| 5,239,696 | 8/1993 | Balch et al. | 340/572 X |
| 5,307,081 | 4/1994 | Harmuth | 343/842 |

OTHER PUBLICATIONS

P. Horowitz and W. Hill, "The Art of Electronics," Second Edition, pp. 360–361, 1989.

*Primary Examiner*—Thomas Mullen

*Attorney, Agent, or Firm*—Robin, Blecker, Daley and Driscoll

[57] ABSTRACT

A transmitter circuit drives a transmit antenna for an electronic article surveillance system with an alternating drive signal. The transmitter circuit includes a DC power supply which converts an AC input power signal into a DC power supply potential, a switching circuit which forms an alternating signal from the DC power supply potential, and a transformer which couples the alternating signal to the antenna. The transformer provides isolation for the transmit antenna, as well as voltage step-down to a desired amplitude for the antenna driving signal. The DC potential supplied to the switching circuit may be regulated or unregulated.

18 Claims, 6 Drawing Sheets

TRANSFORMER COUPLED SWITCHING TRANSMITTER FOR ELECTRONIC ARTICLE SURVEILLANCE SYSTEM

FIELD OF THE INVENTION

This invention is related to electronic article surveillance (EAS) systems and, more particularly, is concerned with transmitter circuitry for use in such systems.

BACKGROUND OF THE INVENTION

It is well known to provide electronic article surveillance systems to prevent or deter theft of merchandise from retail establishments. In a typical system, markers, designed to interact with an electromagnetic field placed at the store exit, are secured to articles of merchandise. If a marker is brought into the field or "interrogation zone", the presence of the marker is detected and an alarm is generated. On the other hand, upon proper payment for the merchandise at a check-out counter, either the marker is removed from the article of merchandise, or, if the marker is to remain attached to the article, then a deactivation procedure is carried out which changes a characteristic of the marker so that the marker will no longer be detected at the interrogation zone.

As is well known, EAS systems typically include transmitting circuitry which generates the electromagnetic field that defines the interrogation zone. One widely used type of EAS system is referred to as a magnetomechanical system, and employs transmitting circuitry that is intermittently operated so as to radiate a 58 kHz interrogation signal in pulses or bursts. The signal bursts excite a magnetostrictive element that is part of the marker and has been selected to mechanically resonate at the interrogation signal frequency. The system includes receiving circuitry that operates between the interrogation signal bursts to detect a residual or "ring-down" signal radiated by the magnetostrictive element of the marker. A magnetomechanical EAS system is marketed by the assignee of the present application under the trademark "ULTRA*MAX" and disclosed, e.g., in U.S. Pat. No. 4,510,489.

An example of a conventional EAS system transmitter apparatus is illustrated in FIG. 1. The transmitter apparatus, generally indicated by reference numeral 10, includes a line frequency transformer 12, a bridge rectifier 14, a half-bridge switching arrangement formed of a voltage divider 16 and a switching transmitter 18, a transmitter control and drive circuit 20, and a transmit antenna 22.

The transformer 12 includes a tapped primary winding 24 and a secondary winding 26. The transformer 12 is arranged to step down the AC power line input from either 120 volts or 240 volts to a desired voltage level. The tapped primary winding 24 permits the transmitter apparatus 10 to be used with both 60 Hz/120 V power systems and 50 Hz/240 V systems, and also permits some adjustment of the level of the signal applied to the antenna 22. The stepped-down AC power is rectified at the rectifier 14, and the resulting DC signal is provided to the transmitter 18 by way of a full level rail 28, a half level rail 30, and a return rail 32. Switches 34 and 36 in the transmitter 18 are controlled by the control and drive circuit 20 to provide an alternating signal at a desired operating frequency (for example, 58 kHz) to the transmit antenna 22. If the transmitter circuitry 10 is being employed in an EAS system of the above-described magnetomechanical type, then the transmitter 18 is controlled by the control and drive circuit 20 so that the 58 kHz signal is generated in bursts.

Although the apparatus 10 operates satisfactorily for its intended purpose, there are, nevertheless, some disadvantages. For example, the amplitude of the drive signal supplied to the antenna 22 fluctuates with ripples in the DC voltage output by the bridge rectifier 14 to the rail 28. Variations in the AC line input level also are reflected by fluctuations in the antenna drive signal level. Also, the line frequency transformer 12 is a large and heavy component and adds significantly to the cost and size of the transmitter apparatus 10.

An alternative conventional EAS transmitter circuitry design is illustrated in FIG. 2. The circuitry of FIG. 2, which is generally indicated by reference numeral 50, is formed of three power conversion stages, namely an unisolated pre-regulator 52, an isolated DC-DC converter 54 and an amplifier/transmitter 56. As indicated in FIG. 2, the DC-DC converter 54 down-converts a stable high voltage level (such as 400 volts) provided by the preregulator 52 into appropriate stable power supply levels to be used at the amplifier-transmitter 56. As a result, the alternating signal used to drive transmit antenna 22 also is stabilized in terms of its maximum amplitude. Nevertheless, the three power conversion stages used in the circuitry 50 of FIG. 2 result in a design that is rather expensive as well as large in size, complex and somewhat inefficient.

OBJECTS AND SUMMARY OF THE INVENTION

It is an object of the invention to provide circuitry for driving a transmit antenna in an EAS system.

It is a further object of the invention to provide EAS transmit circuitry that costs less to manufacture than existing transmitters.

It is another object of the invention to provide EAS transmit circuitry that is smaller in size than existing transmitters.

It is yet a further object of the invention to provide an EAS system transmitter with reduced power consumption.

It is still another object of the invention to provide an EAS transmitter that provides a stable antenna driving signal.

According to an aspect of the invention, there is provided a transmitter circuit for driving an EAS system transmit antenna at a predetermined frequency, the circuit including a signal generating circuit for generating a signal that alternates at the predetermined frequency, and an isolation transformer for coupling to the antenna the signal generated by the signal generating circuit. Further in accordance with this aspect of the invention, the transformer may function to step down the voltage level of the signal generated by the signal generating circuit and to apply the stepped-down signal to the antenna. Also, the signal generating circuit may include a DC power supply for converting an AC input power signal into a DC power supply potential, circuitry for deriving a positive DC level and a negative DC level from the DC power supply potential, and circuitry for alternately applying the positive DC level and the negative DC level to a primary winding of the transformer in accordance with a predetermined cycle to form the signal that alternates at the predetermined frequency. The DC power supply may include a voltage regulator which regulates the level of the DC power supply potential and/or a bridge rectifier.

According to another aspect of the invention, there is provided a method of energizing a transmit antenna in an electronic article surveillance system, including the steps of providing an isolation transformer having a primary winding and a secondary winding, the secondary winding being connected to the transmit antenna, and applying an alternating drive signal to the primary winding of the transformer. Further in accordance with the latter aspect of the invention, the applying step may include providing a switchable circuit connected to the primary winding and switching the switchable circuit between a first condition in which the switchable circuit applies a first DC drive signal to the primary winding and a second condition in which the switchable circuit applies to the primary winding a second DC drive signal that is opposite in polarity to the first DC drive signal. Also, the method in accordance with this aspect of the invention may include the step of deriving the first and second DC drive signals from an unregulated DC level supplied by a bridge rectifier or from a regulated DC level supplied by an unisolated voltage regulator.

According to still another aspect of the invention, there is provided a transmitter circuit for driving a transmit antenna in an electronic article surveillance system, the transmitter circuit including a DC power supply for converting an AC input power signal into a DC power supply potential, a transformer including a primary winding and a second winding, the secondary winding being connected to the transmit antenna, a switchable circuit for switchably interconnecting the DC power supply and the primary winding of the transformer, and a control circuit for switching the switchable circuit between a first condition in which the switchable circuit applies a first drive signal to the primary winding and a second condition in which the switchable circuit applies a second drive signal to the primary winding, the first and second drive signals being substantially equal in amplitude and opposite in polarity.

Further in accordance with this aspect of the invention, the first and second drive signals may have an amplitude that is one-half the amplitude of the DC power supply potential. Moreover, the DC power supply may have a drive rail and a return rail, the primary winding of the transformer may have first and second terminals, and, in such case, the switchable circuit may include a pair of capacitors connected in series between the drive rail and the return rail, the pair of capacitors having a common junction connected to the second terminal of the primary winding, the switchable circuit further including a switch for selectively connecting the drive rail to the first terminal of the primary winding, and a second switch for selectively connecting the return rail to the first terminal of the primary winding. In that case, the control circuit places the first switch in a closed condition and the second switch in an open condition to place the switchable circuit in the above-mentioned first condition, and the control circuit places the first switch in an open condition and the second switch in a closed condition to place the switchable circuit in the above-mentioned second condition. Still further, the control means may selectively place both of the switches in an open condition so that substantially no drive signal is applied to the primary winding.

Still further in accordance with the latter aspect of the invention, the control circuit may switch the switchable circuit between its first and second conditions according to a predetermined cycle to drive the transmit antenna at a desired operating frequency, such as 58 kHz. Also, the DC power supply many include a bridge rectifier and/or a voltage regulator.

The foregoing and other objects, features and advantages of the invention will be further understood from the following detailed description of preferred embodiments and practices thereof and from the drawings, wherein like reference numerals identify like components and parts throughout.

DESCRIPTION OF PREFERRED EMBODIMENTS AND PRACTICES

A preferred embodiment of the invention will now be described with reference to FIGS. 3A–3C and 4.

Figure 3A:
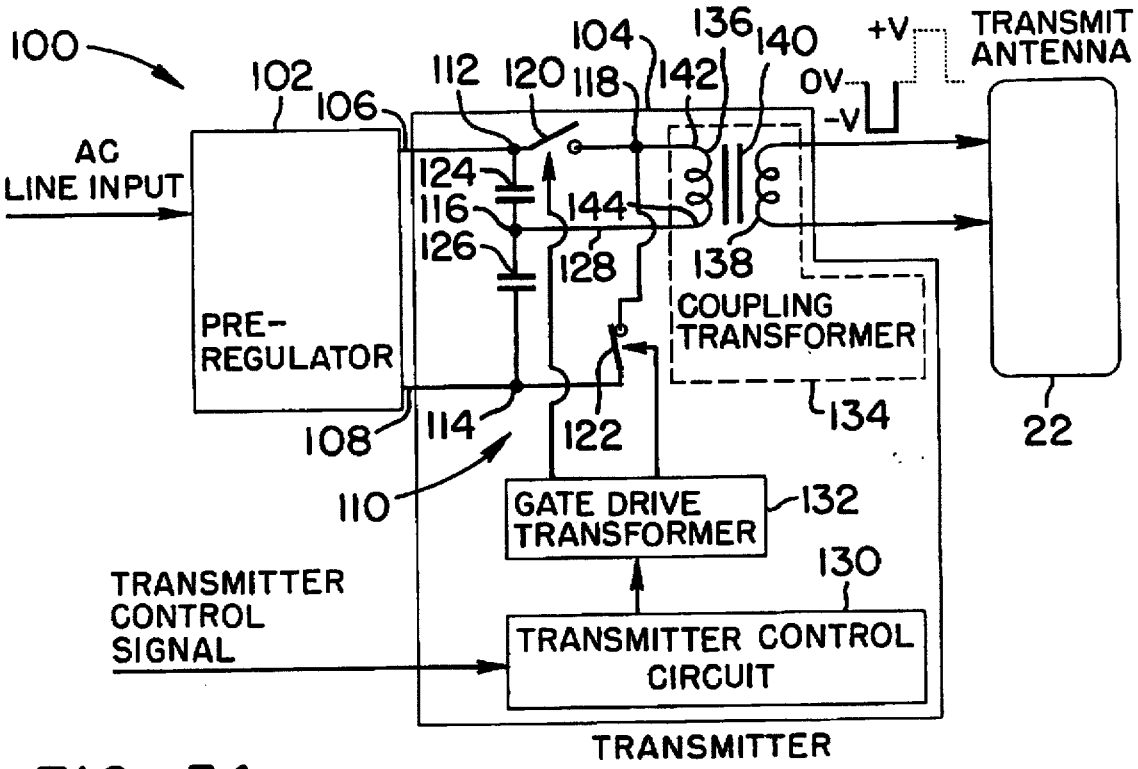
FIGS. 3A–3C illustrate, in block diagram form, transmitter circuitry provided in accordance with the invention, FIG. 3A illustrating a condition of the circuitry during a negative phase of an antenna driving signal, FIG. 3B illustrating a condition of the circuitry during a neutral phase of the driving signal, and FIG. 3C illustrating a condition of the circuitry during a positive phase of the driving signal.

Referring initially to FIG. 3A, transmitter circuitry provided in accordance with the invention, and generally indicated by reference numeral 100, includes a preregulator 102, a transmitter circuit 104, and a transmit antenna 22.

The transmitter circuit 104 is connected to the output of the preregulator 102 by a high voltage rail 106 and a return rail 108. The transmitter 104 includes a half-bridge switching arrangement 110, which has input terminals 112 and 114, output terminals 116 and 118 and switches 120 and 122. The switches 120 and 122 are preferably field effect transistors (FET's) suitable for power switching applications. Also forming part of the half-bridge 110 are a capacitor 124 connected between the input terminal 112 and the output terminal 116, and a capacitor 126 connected between the output terminal 116 and the input terminal 114.

Capacitors 124 and 126 are both of the same value, and accordingly define a voltage divider such that a rail 128 taken out from the output terminal 116 (which is a common junction of the capacitors 124, 126) provides a voltage level that is one-half the level provided at the rail 106. The switch 120 is positioned so as to selectively connect the output terminal 118 to the input terminal 112 and switch 122 is positioned so as to selectively connect the output terminal 118 to the input terminal 114.

Also included in the transmitter 104 are a transmitter control circuit 130 and a gate drive transformer 132 for controlling operation of the switches 120 and 122.

The other major component of the transmitter 104 is an isolation and coupling transformer 134, made up of a primary winding 136 and a secondary winding 138 inductively coupled, via a core 140, to the primary winding 136. The primary winding 136 has a first terminal 142 connected to the output terminal 118 of the half-bridge 110, and a second terminal 144 connected to the output terminal 116 of the half-bridge 110. The secondary winding 138 of the transformer 134 is connected to the transmit antenna 22.

Figure 4:
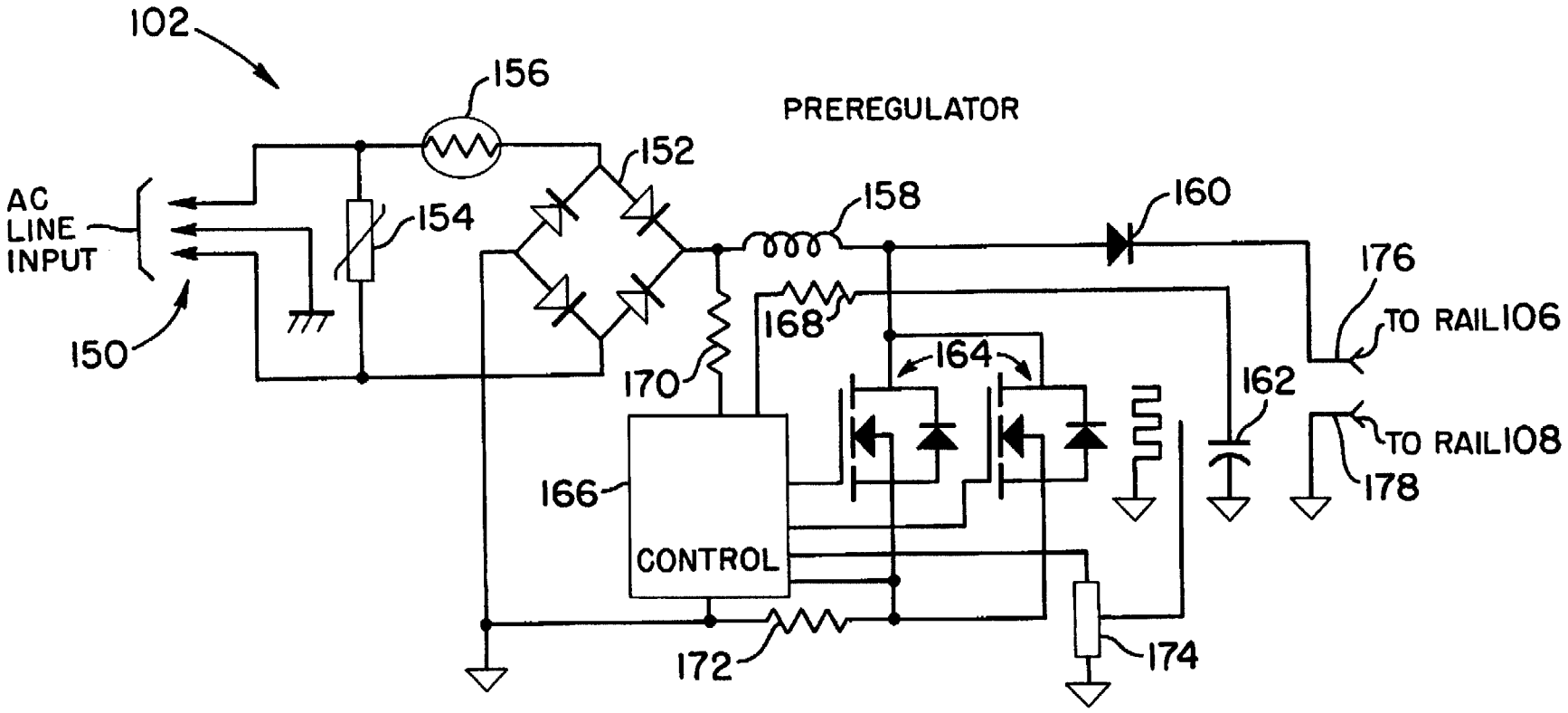
FIG. 4 is a schematic diagram of a preregulator circuit that is part of the transmitter circuitry of FIGS. 3A–3C.

Details of the preregulator 102 are shown in FIG. 4. The preregulator 102 is similar to conventional unisolated preregulators (like preregulator 52 shown in FIG. 2), and therefore will be described only in summary terms. The preregulator 102 includes input terminals 150 and a diode bridge 152 connected across the non-grounded input terminals. Surge protection is provided by a metal oxide varistor 154 connected across the non-grounded input terminals and a thermistor 156 connected between one of the ungrounded terminals and the diode bridge 152. Other major components of the preregulator 102 include an inductor 158, a diode 160, a capacitor 162 and parallel-connected MOSFET's 164, all configured as a conventional DC-DC converter with a control circuit 166 that controls the duty cycle of the MOSFET's 164.

The control circuit 166 operates to stabilize the level of the output DC signal provided at the output of diode 160 while comparing the output signal (provided to the control circuit 166 via a resistor 168) against a reference level generated internally in the control circuit 166. Other inputs are provided to the control circuit 166 from the output of the diode bridge 152 (via a resistor 170) and a current sense signal provided from a current sense resistor 172 connected between the source junction of the MOSFET's 164 and local ground. On the basis of these inputs, the control circuit 166 shapes the outputs of the MOSFET's 164 to match the output of the diode bridge 152. In addition, a temperature compensation signal is provided to the control circuit 166 from a temperature compensation circuit 174.

The preregulator 102 includes an output terminal 176 connected to high voltage rail 106 (FIGS. 3A–3C) and an output terminal 178 connected to the return rail 108. The preregulator 102 provides a stable high voltage DC signal (about 400 volts in a preferred embodiment) for coupling to the rail 106.

In operation, the transmitter 104, and particularly the half-bridge switching arrangement 110 thereof, periodically cycles through three conditions, for respectively applying +200 V, −200 V and 0 V to the primary winding 136 of the coupling transformer 134. In the first condition, shown in FIG. 3C, the transmitter control circuit 130 and the gate drive transformer 132 operate to place switch 120 in a closed condition and switch 122 in an open condition. As a result, the +200 V difference between the full level rail 106 and the half level rail 128 is applied across the primary winding 136. In the second condition, illustrated in FIG. 3A, the control circuit 130 and gate drive transformer 132 operate to place the switch 120 in an open condition and the switch 122 in a closed condition. Consequently, the −200 V difference between the return rail 108 and the half level rail 128 is applied across the primary winding 136. In the third condition, illustrated in FIG. 3B, both switches 120 and 122 are opened, so that no drive signal is applied to the primary winding 136.

The coupling transformer 134 has a suitable ratio of turns in the primary winding 136 relative to the secondary winding 138 so that the signal applied to the primary winding 136 is stepped down to a desired level for the drive signal applied to the transmit antenna 22. The transformer 134 also provides isolation for the transmit antenna drive signal relative to the AC input power line. The secondary winding 138 may also be provided with multiple taps to permit adjustment of the level of the signal applied to the transmit antenna 22.

Figure 1:
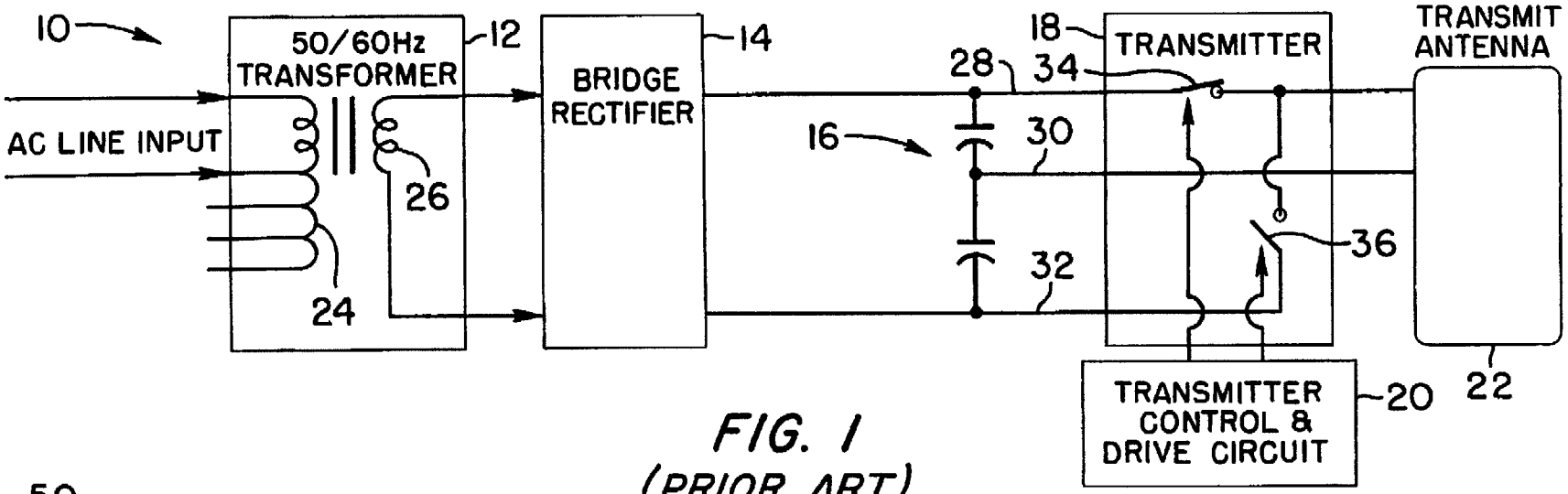
FIG. 1 (PRIOR ART)
FIG. 1 is a block diagram of a conventional EAS transmitter circuit.
Figure 2:
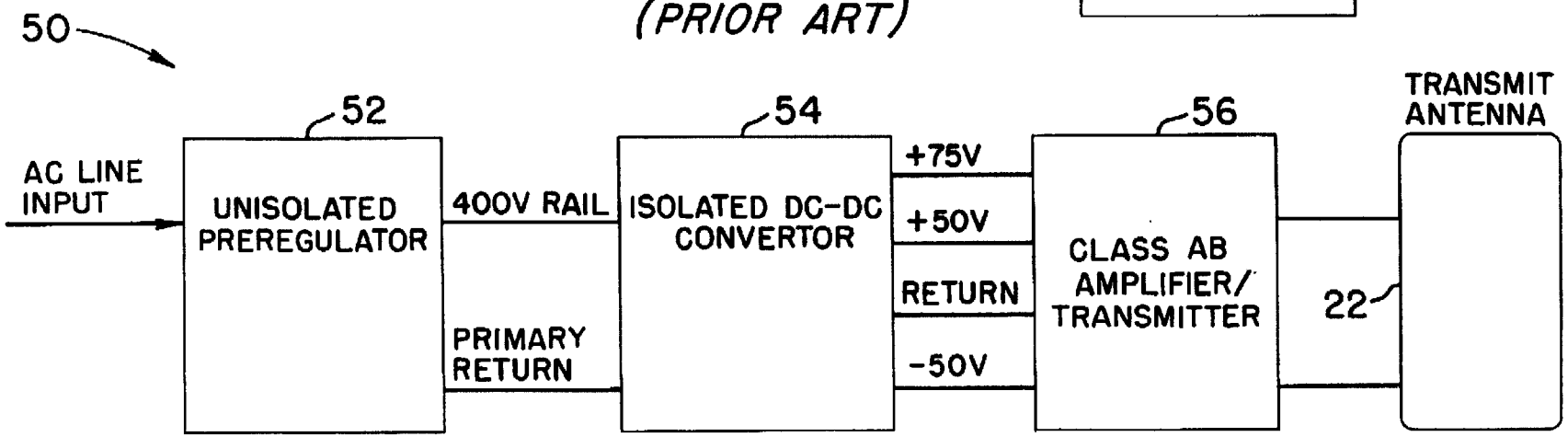
FIG. 2 (PRIOR ART)
FIG. 2 is a block diagram of another example of a conventional EAS transmitter circuit.
Figure 3B:
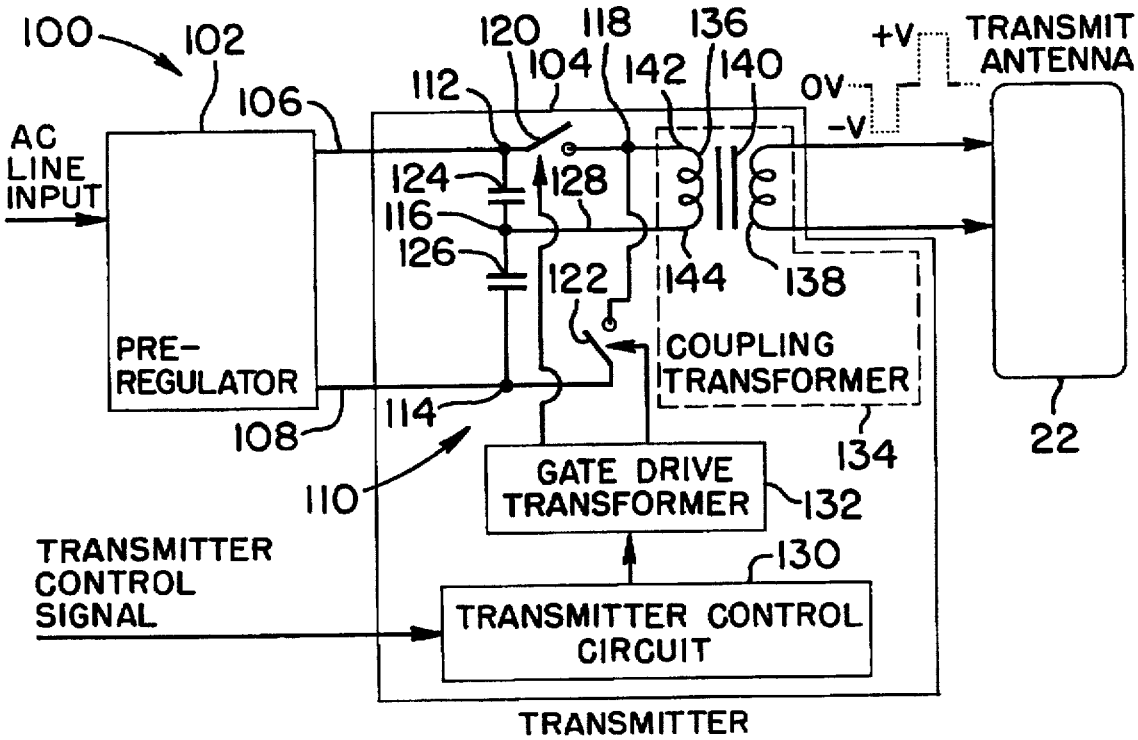
Figure 3C:
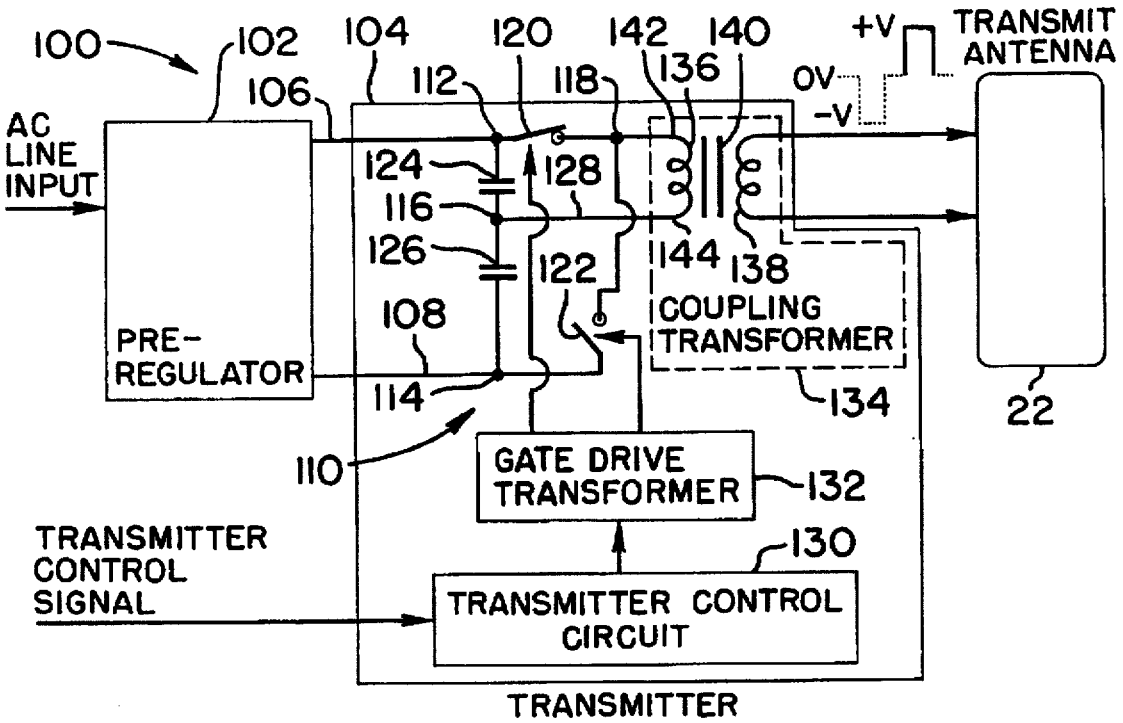

Comparing the arrangement of FIGS. 3A–3C with the conventional transmitter circuitry of FIG. 2, it will be observed that the inventive arrangement of FIGS. 3A–3C provides a stable antenna drive signal with one less power transfer stage than the conventional arrangement of FIG. 2. As a result, the arrangement of FIGS. 3A–3C is smaller in size, lower in weight, more efficient in terms of power consumption, and lower in cost than the conventional arrangement. It is also to be noted that the coupling transformer 134 shown in FIGS. 3A–3C, which operates at a relatively high frequency (e.g., 58 kHz), may be much smaller in size, lighter in weight and less expensive than the heavy-duty line frequency transformer 12 which is part of the conventional arrangement of FIG. 1.

Figure 5:
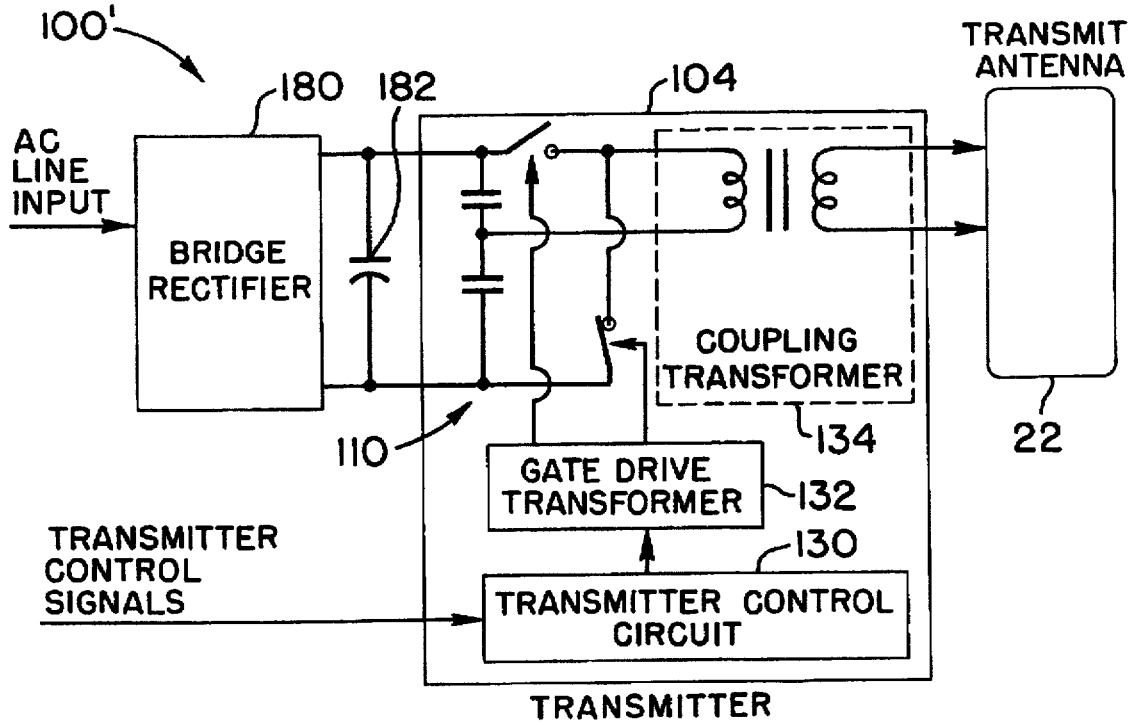
FIG. 5 is a block diagram of transmitter circuitry according to a second embodiment of the invention.

For installations in which a highly-stable antenna driving signal is not required, it is contemplated to modify the embodiment of FIGS. 3A–3C and 4 as indicated in FIG. 5. As seen from FIG. 5, in the modified transmit circuit arrangement 100', the preregulator is replaced with a bridge rectifier 180, and a smoothing capacitor 182 connected across the bridge rectifier 180. In other respects the transmit circuit arrangement 100' of FIG. 5 is unchanged from the arrangement of FIGS. 3A–3C. In particular, the same transmitter circuit 104 is used.

The arrangement 100' of FIG. 5, like the conventional arrangement of FIG. 1, provides an antenna driving signal that is subject to amplitude variation. However, the coupling transformer of the transmitter 104 is smaller, lighter, less expensive, and dissipates less power, than the line frequency transformer used in the arrangement of FIG. 1.

Figure 6:
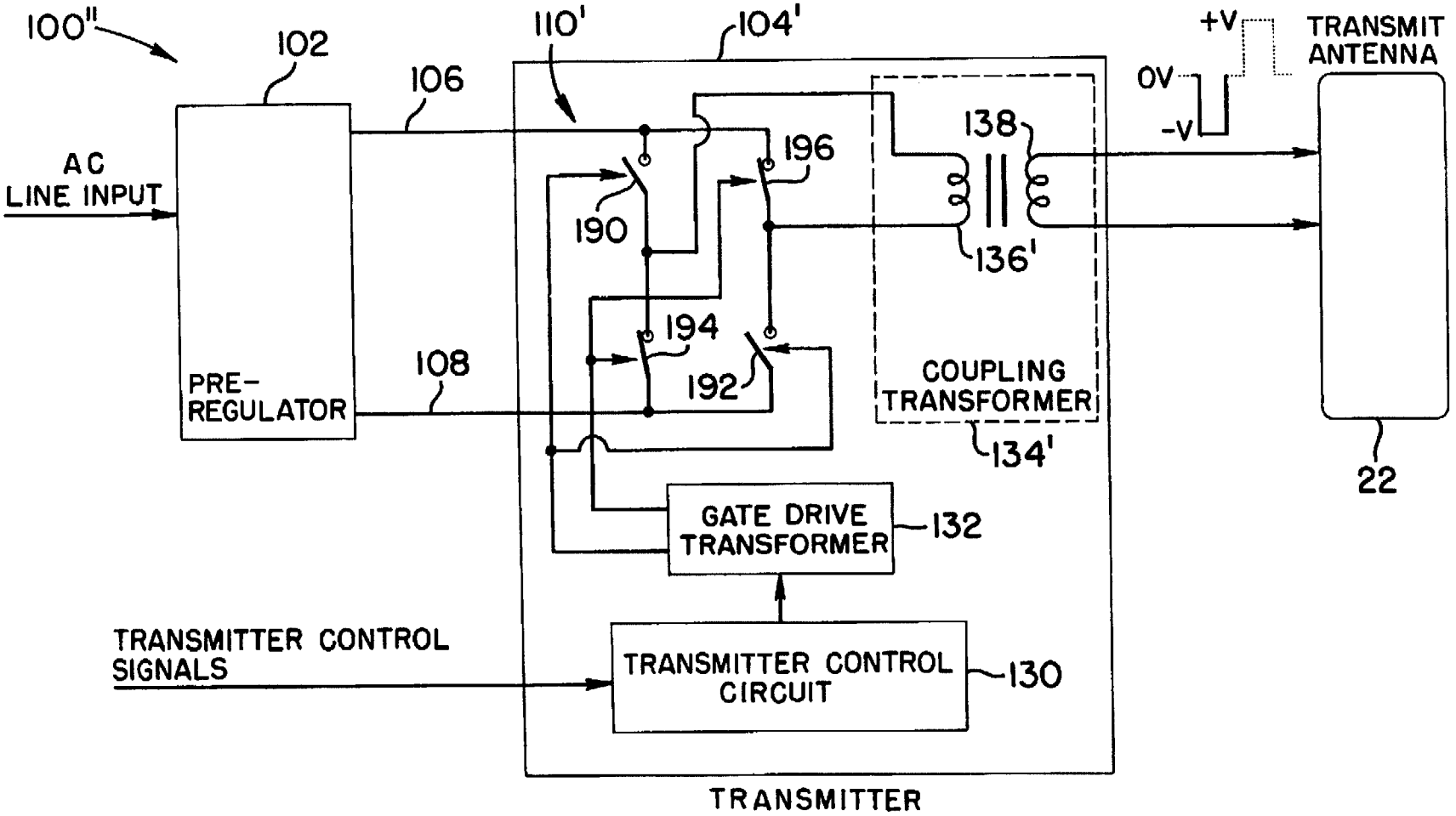
FIG. 6 is a block diagram of transmitter circuitry according to a third embodiment of the invention.

FIG. 6 illustrates another embodiment of the invention, generally indicated by reference numeral 100". This embodiment departs from the first embodiment by replacing the transmitter 104 thereof with a modified transmitter 104'. In the modified transmitter 104', the half-bridge switching arrangement 110 of the transmitter 104 has been replaced with a full-bridge switching arrangement 110'. The full bridge 110' includes a first pair of ganged switches 190 and 192, and a second pair of ganged switches 194 and 196. To provide the negative phase of the antenna drive signal, control circuit 130 and gate drive transformer 132 open the switch pair 190, 192 and close the switch pair 194 and 196 so that the DC potential provided by the preregulator 102 is applied with a negative polarity to the primary winding of the coupling transformer 134'. For the positive phase of the antenna driving signal, the switch pair 190 and 192 is closed and the switch pair 194 and 196 is opened, so that the DC output of the preregulator 102 is applied to the primary winding 136' with a positive polarity. For the neutral phase of the driving signal, all of the switches 190, 192, 194, 196 are opened. Assuming that the output of the preregulator 102 is at the same level as in the first embodiment, then the coupling transformer 134' must have a primary-to-secondary turns ratio that is double that of the coupling transformer 134 in the first embodiment if the signal applied to the transmit antenna 22 is to have the same amplitude as in the first embodiment.

Figure 7:
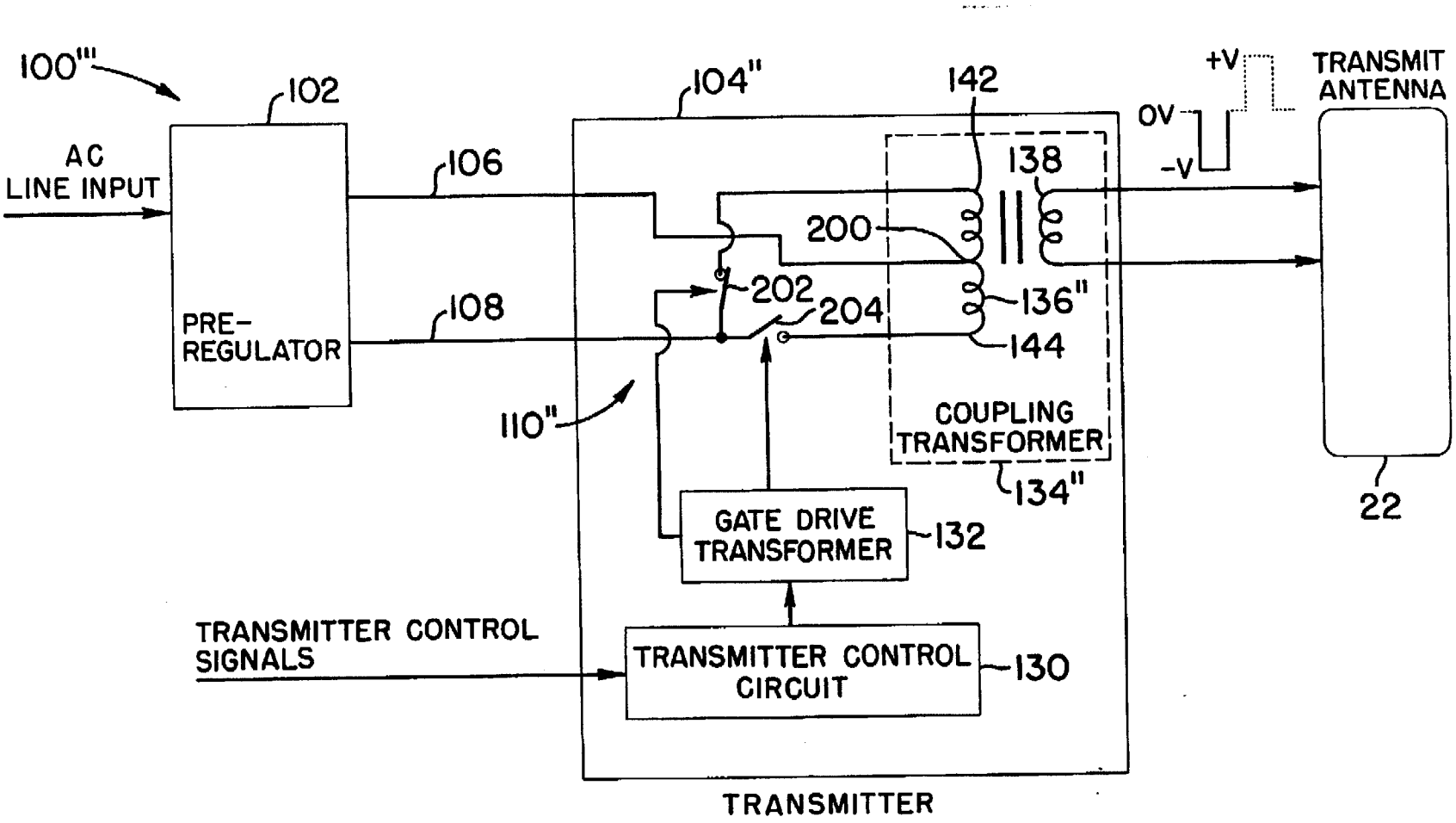
FIG. 7 is a block diagram of transmitter circuitry according to a fourth embodiment of the invention.

In a fourth embodiment of the invention, shown as transmitter circuitry 100'" in FIG. 7, the half-bridge switching arrangement 110 of the first embodiment is replaced with a push-pull switching arrangement 110". Furthermore, the modified transmitter circuit 104" of FIG. 7 includes a coupling transformer 134" which has a center-tapped primary winding 136". The center-tap 200 of the primary winding 136" is connected to the high voltage rail 106. A first terminal 142 of the winding 136" is selectively connectable to the return rail 108 by a switch 202. The second terminal 144 of the winding 136" is also selectively connectable to the return rail 108, via a switch 204.

To provide the negative phase of the antenna drive signal, the switch 202 is placed in a closed position, and the switch 204 is placed in an open condition. For the positive phase of the antenna drive signal, the switch 204 is closed and the switch 202 is opened. Both of switches 204 and 202 are opened to obtain the neutral phase of the antenna drive signal.

The turns ratio of the primary winding 136" and the secondary 138 is selected to provide the desired level of antenna drive signal for the transmit antenna 22.

It will be recognized that an alternative push-pull switching arrangement may be provided in which the center-tap 200 of the primary winding 136" is connected to the return rail 108, with the rail 106 being selectively connectable, through respective switches, to the terminals 142 and 144 of the primary winding 136".

It is also contemplated that the full-bridge and push-pull switching arrangements of FIGS. 6 and 7 may be used in the unregulated transmit circuit shown in FIG. 5.

Furthermore, the coupling transformer used in each of the embodiments may have a secondary winding with several taps to permit adjustment of the level of the antenna drive signal, as was discussed in connection with the first embodiment.

In addition to the above-mentioned advantages in terms of size, weight, energy efficiency and cost, the switching arrangements described herein permit interfacing to ground-referenced control circuitry, thereby providing further cost savings.

In a preferred embodiment, the transformer-coupled switching transmitters disclosed herein are applied in a magnetomechanical EAS system, but it is also contemplated to apply the invention to other types of EAS systems.

Various changes in the foregoing apparatus and modifications in the prescribed practices may be introduced without departing from the invention. The particularly preferred methods and apparatus are thus intended in an illustrative and not limiting sense. The true spirit and scope of the invention is set forth in the following claims.

What is claimed is:

1. A transmitter circuit for driving an EAS system transmit antenna at a predetermined frequency, comprising:

signal generating means for generating a signal that alternates at said predetermined frequency; and an isolation transformer for coupling to said antenna said signal generated by said signal generating means;

said signal generating means including:

DC power supply means for converting an AC input power signal into a DC power supply potential;

means for deriving a positive DC level and negative DC level from said DC power supply potential; and means for alternately applying said positive DC level and said negative DC level to a primary winding of said transformer in accordance with a predetermined cycle to form said signal that alternates at said predetermined frequency.

2. A transmitter circuit according to claim 1, wherein said transformer steps down a voltage level of said signal generated by said signal generating means and applies the stepped-down signal to said antenna.

3. A transmitter circuit according to claim 1, wherein said DC power supply means includes a bridge rectifier.

4. A transmitter circuit according to claim 1, wherein said DC power supply means includes voltage regulator means for regulating a level of said DC power supply potential.

5. A transmitter circuit for driving an EAS system transmit antenna at a predetermined frequency, comprising:

signal generating means for generating a signal that alternates at said predetermined frequency; and a step-down transformer for stepping-down a voltage level of said signal generated by said signal generating means and applying the stepped-down signal to said antenna;

said signal generating means including:

DC power supply means for converting an AC input power signal into a DC power supply potential;

means for deriving a positive DC level and negative DC level from said DC power supply potential; and means for alternately applying said positive DC level and said negative DC level to a primary winding of said transformer in accordance with a predetermined cycle to form said signal that alternates at said predetermined frequency.

6. A transmitter circuit according to claim 5, wherein said DC power supply means includes a bridge rectifier.

7. A transmitter circuit according to claim 5, wherein said DC power supply means includes voltage regulator means for regulating a level of said DC power supply potential.

8. A method of energizing a transmit antenna in an electronic article surveillance system, comprising the steps of:

providing an isolation transformer having a primary winding and a secondary winding, said secondary winding being connected to said transmit antenna; and applying an alternating drive signal to said primary winding;

said applying step including providing a switchable circuit connected to said primary winding and switching said switchable circuit between a first condition in which said switchable circuit applies a first DC drive signal to said primary winding and a second condition in which said switchable circuit applies to said primary winding a second DC drive signal that is opposite in polarity to said first DC drive signal.

9. A method according to claim 8, further comprising the step of deriving said first and second DC drive signals from an unregulated DC level supplied by a bridge rectifier.

10. A method according to claim 8, further comprising the step of deriving said first and second DC drive signals from a regulated DC level supplied by an unisolated voltage regulator.

11. A transmitter circuit for driving a transmit antenna in an electronic article surveillance system, the transmitter circuit comprising:

DC power supply means for converting an AC input power signal into a DC power supply potential;

a transformer including a primary winding and a secondary winding, said secondary winding being connected to said transmit antenna;

switchable means for switchably interconnecting said DC power supply means and said primary winding of said transformer; and control means for switching said switchable means between a first condition in which said switchable means applies a first drive signal to said primary winding and a second condition in which said switchable means applies a second drive signal to said primary winding, said first and second drive signals being substantially equal in amplitude and opposite in polarity.

12. A transmitter circuit according to claim 11, wherein said first and second drive signals have an amplitude that is one-half an amplitude of said DC power supply potential.

13. A transmitter circuit according to claim 11, wherein said DC power supply means has a drive rail and a return rail, said primary winding of said transformer has first and second terminals, and said switchable means includes:

a pair of capacitors connected in series between said drive rail and said return rail, said pair of capacitors having a common junction connected to the second terminal of said primary winding;

a first switch for selectively connecting said drive rail to the first terminal of said primary winding; and a second switch for selectively connecting said return rail to said first terminal of said primary winding;

said control means placing said first switch in a closed condition and said second switch in an open condition to place said switchable means in said first condition, and said control means placing said first switch in an open condition and said second switch in a closed condition to place said switchable means in said second condition.

14. A transmitter circuit according to claim 13, wherein said control means selectively places both of said switches in an open condition so that substantially no drive signal is applied to said primary winding.

15. A transmitter circuit according to claim 11, wherein said control means switches said switchable means between said first and second conditions according to a predetermined cycle to drive said transmit antenna at a desired operating frequency.

16. A transmitter circuit according to claim 15, wherein said desired operating frequency is 58 kHz.

17. A transmitter circuit according to claim 11, wherein said DC power supply means includes a bridge rectifier.

18. A transmitter circuit according to claim 11, wherein said DC power supply means includes voltage regulator means for regulating a level of said DC power supply potential.

* * * * *